United States Patent [19]

Hirayama

[11] Patent Number: 5,044,988

[45] Date of Patent: Sep. 3, 1991

[54] MOUNTING DEVICE FOR ELECTRICAL CONNECTORS

[75] Inventor: Naohiro Hirayama, Yokohama, Japan

[73] Assignee: AMP Incorporated, Harrisburg, Pa.

[21] Appl. No.: 573,426

[22] Filed: Aug. 24, 1990

[30] Foreign Application Priority Data

Aug. 24, 1989 [JP] Japan ..... 1-98759

[51] Int. Cl.[5] ..... H01R 13/627

[52] U.S. Cl. ..... 439/571; 439/609

[58] Field of Search ..... 439/571, 573, 609

[56] References Cited

U.S. PATENT DOCUMENTS

| | | | |
|---|---|---|---|
| 4,009,921 | 3/1977 | Narozny | 439/573 X |
| 4,693,532 | 9/1987 | Colleran et al. | 439/594 |
| 4,842,552 | 6/1989 | Frantz | 439/573 X |
| 4,842,554 | 7/1989 | Cosmos et al. | 439/609 |
| 4,907,987 | 3/1990 | Douty et al. | 439/571 |
| 4,943,244 | 6/1990 | Teck et al. | 439/571 X |

*Primary Examiner*—Eugene F. Desmond

*Attorney, Agent, or Firm*—Allan B. Osborne; Adrian L. LaRüe

[57] ABSTRACT

A mounting device (14, 21, 23, 100) separate from a connector housing (11) for mounting the connector (10) onto a circuit board (13, 20). The device (14, 21, 23) includes a pair of legs (16, 102) or clips (21*a*) for engaging the circuit board (13, 20) and a retention section (17, 24, 25, 101) for engaging the connector housing (11).

7 Claims, 2 Drawing Sheets

MOUNTING DEVICE FOR ELECTRICAL CONNECTORS

FIELD OF THE INVENTION

The present invention relates to a device for mounting electrical connectors to a circuit board or substrate.

BACKGROUND OF THE INVENTION

In mounting on a circuit board an electrical connector having contacts secured in a plastic housing, it is typical to mount such connector on the circuit board by inserting retention legs integral with the housing and extending downwardly (towards the circuit board) from the bottom edge of the housing into holes bored in the circuit board at predetermined locations. In such, connectors having retention legs integrally formed with the housing, various housings having legs of different configuration must be prepared to fit different types of circuit boards on which the connectors are to be mounted. This is inherently impractical or inefficient.

It is therefore an object of the present device to provide an electrical connector having a versatile housing capable of engaging a circuit board regardless of the configuration of the retention legs to be mounted on the circuit board.

SUMMARY OF THE INVENTION

According to the invention, a mounting device for electrical connectors is provided which have legs on one end for engaging a circuit board and a retention section at another end for engaging the connector housing.

DESCRIPTION OF THE INVENTION

Figure 1:
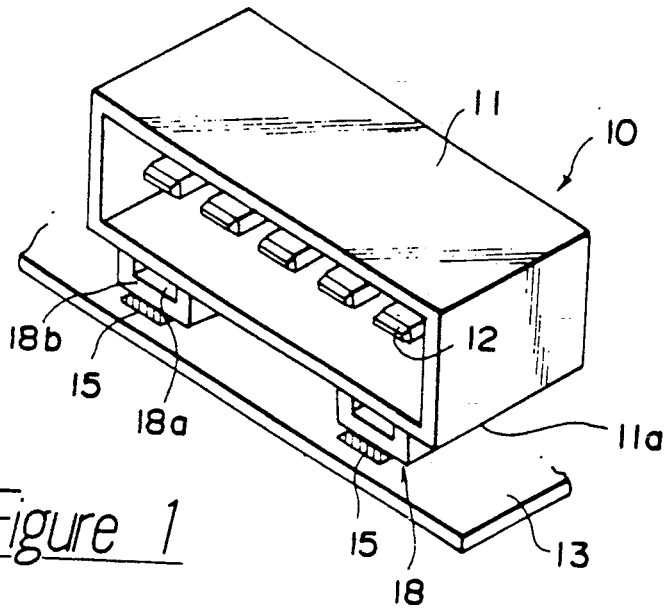
FIG. 1 is a partial perspective view of one embodiment of the electrical connector according to the present device.
Figure 2A:
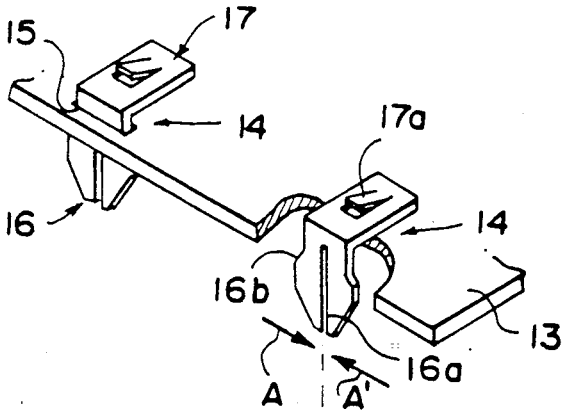
FIG. 2A is a perspective view of one part of the electrical connector in FIG. 1.
Figure 2B:
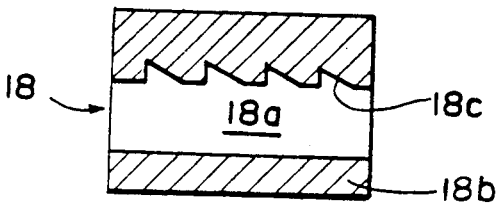
FIG. 2B is a partial cross-sectional view of the embodiment in FIG. 1.

Illustrated in FIG. 1 is a connector 10 having a housing 11 made by plastic molding and contacts 12 secured inside housing 11. The connector 10 is mounted on circuit board 13 engaging sections 18, integrally formed with housing 11 on the bottom surface 11*a* facing circuit board 13 with the mounting devices 14 mounted on the circuit board 13. As illustrated in FIG. 2A, the devices 14, 14 comprise L-shaped mounting sections 16 to be mounted on the circuit board by pressing into holes 15, 15 of board 13 at predetermined locations in circuit board 13 and retention sections 17 to support the housing 11. The mounting sections 16 at the circuit board side have larger width than the openings 15. However, provision of vertical slits 16*a* allows the mounting sections 16 to deform in the width direction when they are pressed into the holes 15. That is, when the mounting sections 16 are to be pressed into holes 15, they are pushed in the direction shown by the arrows A, A' to reduce the width of the mounting sections 16 smaller so as to be than that of the holes 15, thereby inserting the mounting sections 16 into the holes 15. Upon insertion, the mounting sections 16 restore their initial shape to engage tapered section 16*b* of the mounting sections 16 with the bottom surface of the circuit board 13. The devices 14 are first mounted on housing 11 by engaging sections 18 and the devices 14 by latching the lances 17*a* extending upwardly from the retention sections 17 of the devices 14 with step portions 18*c* (FIG. 2B) in the upper wall in aperture sections 18*a* of the leg engaging sections 18. A plurality of step portions 18*c* are formed along the length of sections 18, thereby providing proper choice of latching locations. The housing 11 having the engaging sections 18 engaged with the respective devices 14 is mounted on the circuit board 13 by pressing the devices 14 into the holes 15 in the circuit board 13 as mentioned above.

Figure 3:
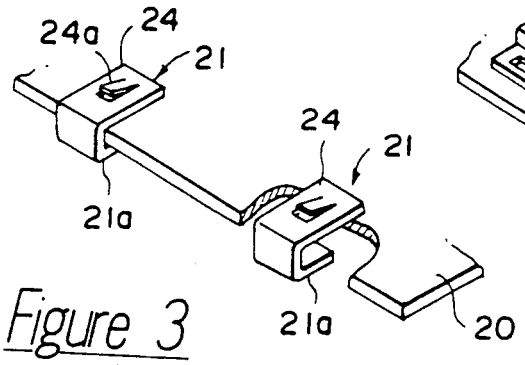
FIG. 3 is a perspective view of one part of another embodiment.
Figure 4:
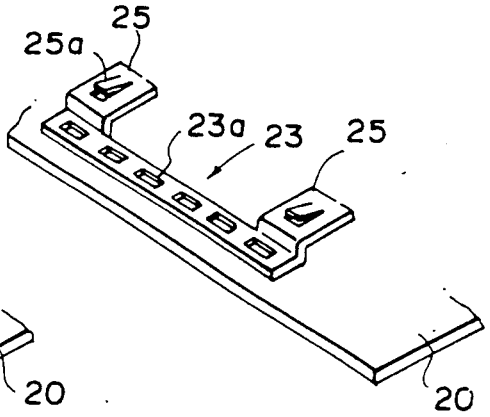
FIG. 4 is a perspective view of one part of still another embodiment.

Next, described is an embodiment of a connector having mounting devices suited for a surface mount type circuit board. A surface mount type circuit board; e.g. board 20 shown in FIGS. 3 and 4, requires no openings 15. There are proposed two approaches to mount mounting devices without boring holes in a circuit board. One is mounting devices 21, 21 as illustrated in FIG. 3 to clip onto the circuit board 20 at appropriate locations and soldered for mounting. The other is a mounting device 23 directly soldered on the circuit board 20 as illustrated in FIG. 4. The devices 21 of FIG. 3 comprise mounting sections 21*a* to clip onto the edge of the circuit board 20 for mounting retention sections 24 to retain housing 11. The retention sections 24 are essentially the same configuration as retention sections 17 and are similarly engaged with engaging sections 18. The housing 11 is then mounted on the circuit board 20 by devices 21 being clipped to it.

The device 23 of FIG. 4 has a pair of retention sections 25, 25 as an integral part of the mounting section 23*a* coupling the retentions sections 25, 25. The retention sections 25 are the same as retention sections 17, 24. Accordingly, the housing 11 can be mounted on the circuit board 20 by engaging the left and right retention sections 25 engagable with engaging sections 18 in the housing 11 of FIG. 1 and mounting the mounting section 23*a* onto circuit board 20.

Figure 5:
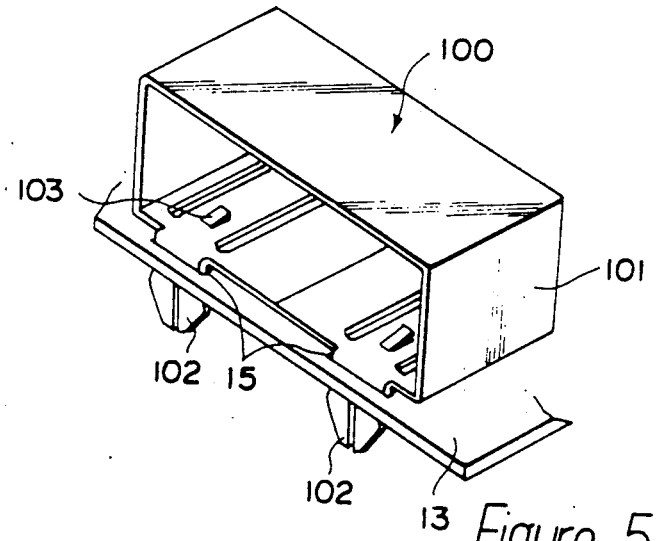
FIG. 5 is a perspective view of further embodiment.

A further embodiment will be described by reference to FIG. 5. A mounting device 100 of FIG. 5 comprises a box-shaped retention section 101 to receive a housing (not shown) therein and mounting sections 102 engagable with holes 15 in the circuit board 13. The retention section 101 and the mounting sections 102 of the device 100 are made of a metal as an integral part, thereby providing shielding effect when enclosing and holding the connector housing therein. This embodiment utilizes the mounting sections 102 to be pressed into the holes 15 in the circuit board. Other mounting sections such as those in the second and the third embodiments may be used as well in order to accommodate various circuit boards.

In other words, a housing is mated with the retention section 101 within the device 100 by engaging the engaging lances 103 formed on the bottom inner wall of the retention section 101 with engaging sections formed in the box-shaped housing at the corresponding locations to the engaging lances 103, thereby mounting the connector on the circuit board. Accordingly, a connector housing of common configuration may be conveniently mounted on a circuit board similar to the other embodiments by simply modifying the mounting section. It is also true in these embodiments that the mounting location of the housing 11 on the circuit board may be selected freely to a certain degree by engaging the lances 24*a*, 25*a* on the devices 21, 23 with different step portions 18*c* of the engaging sections 18 in a similar manner to the first embodiment.

As mentioned hereinbefore, the engaging portion of connector housings can be constant or standardized while allowing the mounting of housings of any configuration or by standardizing the housing configuration.

The above embodiments enable one to mount housings of standardized configuration on various circuit boards by simply modifying the mounting devices to meet the circuit board requirements. That is, simple replacement of the devices is required to mount such connector housings on different circuit boards. Connectors having common retention sections and engaging sections are very useful.

ADVANTAGES OF THE APPLICATION

The electrical connector according the present device features separate connector housings and mounting device and then to engage the connector housing with the mounting device to secure the connector on a circuit board. Accordingly, a standardized connector housing main body can be mounted on mounting device of different configurations.

I claim:

1. An electrical connector for mounting onto a circuit board, comprising:

a dielectric housing having electrical contacts secured therein and including engaging-section means along a bottom wall of said housing;

mounting device means including mounting means for mounting the mounting device means onto the circuit board and retention means for latchable engagement with said engaging section means of said housing thereby mounting the connector onto the circuit board.

2. An electrical connector as claimed in claim 1, wherein said engaging section means comprise sections having apertures therethrough extending outwardly from and along the bottom wall of said housing at spaced locations thereof, said retention means being secured in said apertures.

3. An electrical connector as claimed in claim 2, wherein upper walls of said sections have step portions engaged by lances of said retention means.

4. An electrical connector as claimed in claim 1, wherein said mounting means are plates having vertical slits thereby defining legs which have tapered sections along outer edges, said plates being insertable into rectangular-shaped apertures in the circuit board with the tapered sections engaging a bottom surface of the circuit board.

5. An electrical connector as claimed in claim 1, wherein said mounting device means have a J-shape so as to be clipped onto an edge of the circuit board at spaced locations.

6. An electrical connector as claimed in claim 1, wherein said mounting means is a plate extending between said retention means.

7. An electrical connector as claimed in claim 1, wherein said retention means is a box-shaped member in which said housing is disposed including lances extending upwardly from a lower wall of said box-shaped member engaging said engaging-section means of said housing.

* * * * *